United States Patent [19]

Hemm et al.

[11] Patent Number: 4,927,028

[45] Date of Patent: May 22, 1990

[54] PACKAGE HAVING A TEAR-OPEN STRIP

[75] Inventors: Gerhard Hemm, Sottrum; Gerhard Clausing; Heiko Pietzsch, both of Berlin, all of Fed. Rep. of Germany

[73] Assignee: Jacobs Suchard AB, Zurich, Switzerland

[21] Appl. No.: 208,051

[22] Filed: Jun. 17, 1988

[30] Foreign Application Priority Data

Jul. 2, 1987 [DE] Fed. Rep. of Germany ..... 3721890
Nov. 2, 1987 [DE] Fed. Rep. of Germany ..... 3737111
Mar. 8, 1988 [DE] Fed. Rep. of Germany ..... 3807469

[51] Int. Cl.[5] ..... B65D 27/38

[52] U.S. Cl. ..... 206/618; 206/524.8; 206/632; 206/633

[58] Field of Search ..... 206/610, 605, 613, 632, 206/633, 617, 618, 616, 611, 604, 524.8

[56] References Cited

U.S. PATENT DOCUMENTS 3,215,335 11/1965 Turpin ..... 206/618
4,027,455 6/1977 Rausing ..... 206/618 X
4,364,478 12/1982 Tüns ..... 206/605
4,428,485 1/1984 Egli ..... 206/604
4,629,071 12/1986 Tani ..... 206/618
4,650,079 3/1987 Tani ..... 206/616
4,705,174 11/1987 Goglio ..... 206/632

FOREIGN PATENT DOCUMENTS 0209148 1/1987 European Pat. Off. .
54938 3/1967 Fed. Rep. of Germany .
7508452 3/1975 Fed. Rep. of Germany .
3306314 10/1984 Fed. Rep. of Germany .
8612836 5/1986 Fed. Rep. of Germany .
2558802 2/1985 France .
103423 1/1974 German Democratic Rep. .

*Primary Examiner*—Bryon P. Gehman
*Attorney, Agent, or Firm*—Burns, Doane, Swecker & Mathis

[57] ABSTRACT

A package for holding pourable products includes a body of composite sheet material having a closure seam that extends across the body. A tear-open strip is positioned on the body between the block and the closure seam and a side weld is located along a portion of the side edge of the package. A punch cut which defines a grip tab, is positioned in the side weld. The grip tab is adapted to be gripped by a user in order to initiate tearing of the pacakge.

15 Claims, 3 Drawing Sheets

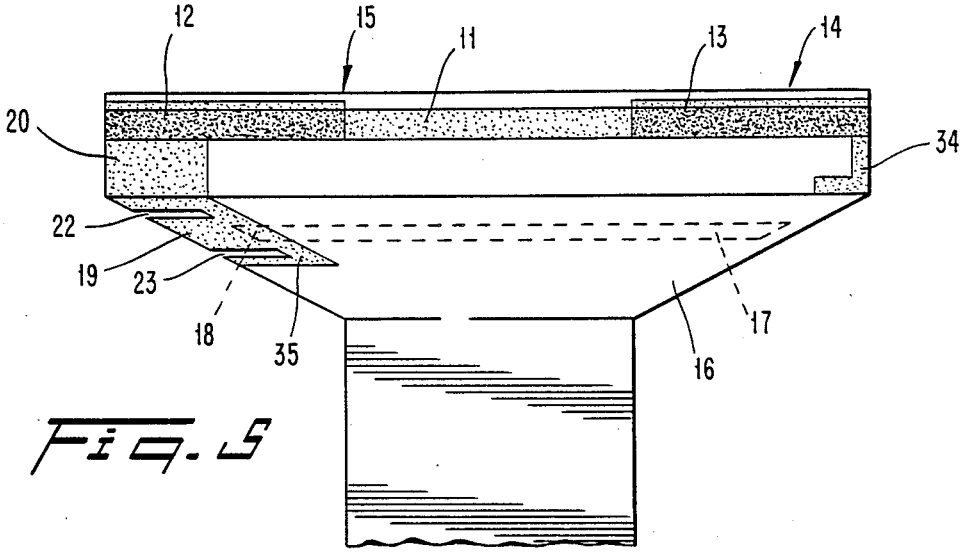
Fig. 5
Fig. 6
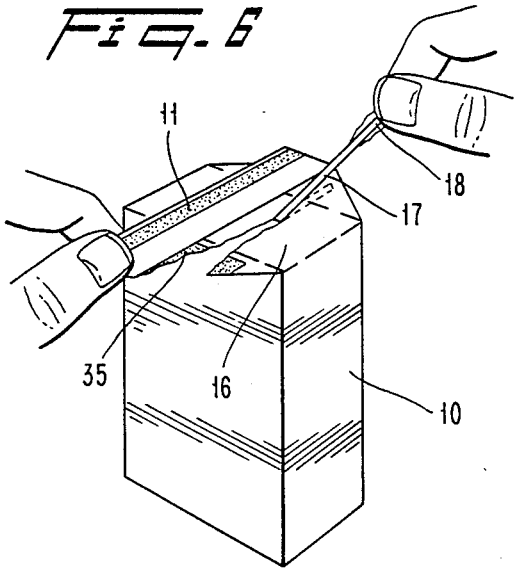

PACKAGE HAVING A TEAR-OPEN STRIP

FIELD OF THE INVENTION

The invention relates to a package and more particularly, a package for holding pourable contents.

BACKGROUND OF THE INVENTION

Commodities which are sensitive in respect of aroma, particularly ground roasted coffee, are frequently sold to the final consumer in vacuum packs. The vacuum pack usually consists of a multilayer composite sheet including metallized layers and an inner layer of thermoplastic material. The pack is produced from a continuous sheet tube, usually having a tube seam extending in the longitudinal direction, by cutting off portions of the tube. After being filled and evacuated, the tube portion is airtightly closed by transversely directed top and bottom closure seams.

In the case of ground roasted coffee the contents of the evacuated pack are formed into a cuboidal block which is stable in respect of shape. Projecting parts of the sheet tube at the top and bottom are folded flat for the formation of the closure seams. This results in a formation of the top and bottom end regions of the pack which is known as a fin fold. These parts are folded against the top and bottom faces of the coffee block. Roughly triangular flaps projecting at the sides are likewise folded against the top and bottom faces of the block. A shaped product of overall cuboidal shape is thus obtained, which is generally placed in an outer package of cardboard or coated paper.

The invention relates to proposals for enabling composite sheet packs of this kind to be opened without problems.

It is already known to provide a transversely directed tear-open strip under the (top) closure seam of a vacuum pack. At an end of this strip, located at the edge, the welded composite sheet forms a grip tab which can be gripped in order to open the pack with the aid of the tear-open strip. The grip tab is defined by two parallel stamp cuts in the composite sheet, which are made at the side of the end of the tear-open strip (DE-GM No. 75 08 452.5).

This form of opening mechanism for the vacuum pack leads to inadequate airtightness of the pack, so that the vacuum is impaired or destroyed before the pack is used. In addition, this known vacuum packing still does not allow optimum handling of the tear-open strip.

The problem underlying the invention is that of so constructing a pack, particularly a vacuum pack for (ground) roasted coffee or the like, that despite an easily operated tear-open mechanism durable airtightness for the purpose of maintaining the vacuum is ensured.

SUMMARY OF THE INVENTION

For the solution of this problem the vacuum pack according to the invention is characterized in that an end (gripping end) of the tear-open strip faces the grip tab ends or is disposed at such a distance from the punch cuts as to ensure the leaktightness of the welded composite sheet (side weld).

The invention is based on the realization that the making of the punch cuts delimiting the grip tab gives rise to considerable risk in respect of leaktightness in conjunction with the tear-open strip disposed on the inner side of the composite sheet. In accordance with the realization underlying the invention this strip in fact forms fine capillary channels next to the tear-open strip in the region of the vacuum sheets welded together. If the distance between the welded sheet walls (side weld) and the punch cuts is now too short, this will result in a potential loss of leaktightness of the pack.

In a particularly advantageous embodiment of the invention the tear-open strip ends at a distance viewed in the longitudinal direction of the tear-open strip—from the punch cuts delimiting the grip tab, but is preferably anchored within the side weld. In this case there is no risk that the leaktightness of the pack in the region of the punch cuts will deteriorate. The operation of tearing open the pack can nevertheless be carried out without problems, because when the grip tab is held and pulled the tear and dividing lines converge in the direction of the tear-open strip. The latter accordingly enables the pack to be torn open successfully even if the tear-open strip ends a definite distance before the region of the punch cuts and therefore, before the region of the grip tab.

Another particular feature of the invention consists of the formation of the grip tab itself. According to the invention this tab is formed some distance from the side edge of the pack, by means of a U-shaped or similarly shaped punch cut within the side weld. This results in a grip tab which is formed at a distance from the edge of the pack or of the fin fold and which can be gripped when pressed out to one side. A closed, frame-like part of the (welded) composite sheet is thus left behind, which can be held particularly firmly between the thumb and forefinger during the opening operation. This construction of the grip tab can also be used other types of sheet packs, that is to say not solely in vacuum packs, as part of a tear-open mechanism using a tear-open strip.

According to the invention the tear-open mechanism may also be disposed in the region of a trapeziform transition portion of the fin fold, while a side weld joining together the two sheet walls and provided with a grip tab is likewise disposed in the region of the transition portion.

Other features of the invention relate to the shape and arrangement of the grip tab and tear-open strip.

BRIEF DESCRIPTION OF THE DRAWINGS

Examples of embodiment of the invention are explained more fully below with reference to the drawings, in which like elements bear like reference numerals and wherein:

FIG. 5 is a side view of an additional embodiment of the present invention;

FIG. 6 is a perspective view of the manner in which the tear-open strip of the present invention is operated.

DETAILED DESCRIPTION OF THE PRESENT INVENTION

Figure 1:
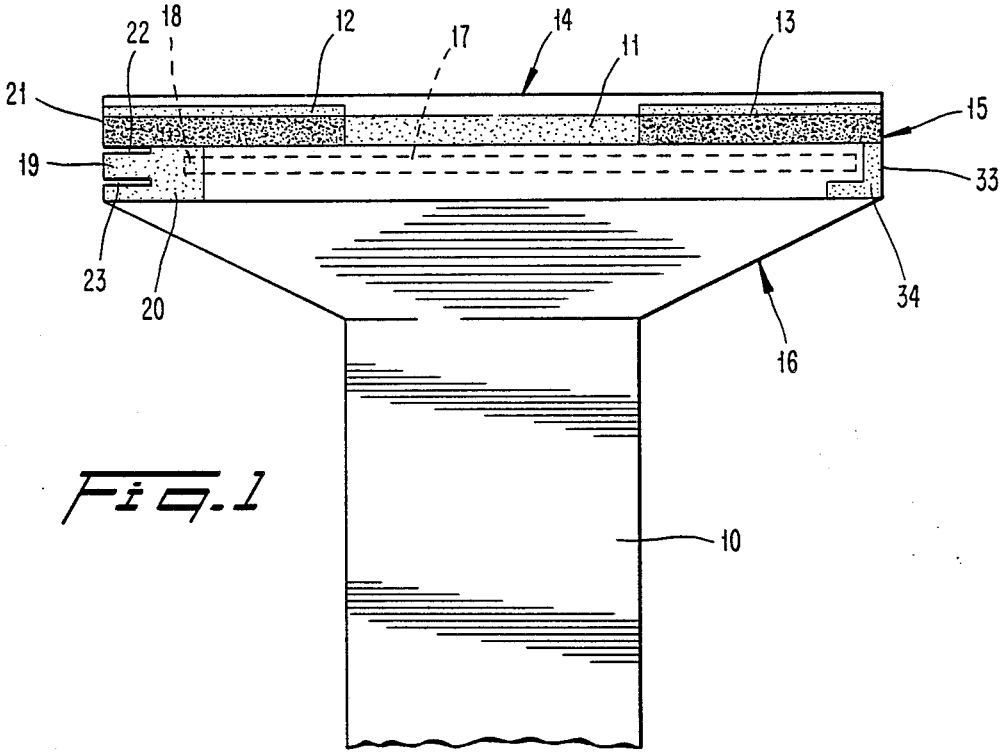
FIG. 1 is a side view of the top part of a vacuum pack provided with a fin fold.

The vacuum packs shown in the drawings serve to hold ground roasted coffee. The basic structure of a vacuum pack of this kind comprises an outer wrapping (not shown) of paper or cardboard and an inner packing constituting the actual vacuum pack. The latter consists of a portion of a tube of a multilayer aroma-tight and airtight composite sheet. The construction of the pack is such that at least one inside coating consists of heat-sealable or weldable plastics material. An intermediate layer usually consists of metal.

For the production of the vacuum pack in a manner known per se, a continuous sheet tube having a seam extending in its longitudinal direction is first formed. Individual tube portions are cut off from this sheet tube, each being used to form a vacuum pack. After a bottom transversely directed closure seam (not shown) has been made by thermal welding, the bag-shaped pack is filled and then evacuated. During the evacuation the contents of the pack (e.g., ground roasted coffee) is formed into a cuboidal block, namely a coffee block 10, by appropriate external shaping means (not shown). The block 10 is solid and stable with respect its shape because of the vacuum inside the pack.

The top end of the tubular pack is likewise leaktightly closed by a transversely directed closure seam 11, this being achieved with the aid of appropriate known heat-sealing jaws (not shown). In the present case, side part seams 12, 13 are first formed, to leave free a roughly central opening for the evacuation operation. The closure seam 11 extending over the entire width is then formed.

The pack constructed in this manner forms a fin fold 14 projecting from the coffee block 10 in the regions above and below said block. This fold consists of a rectangular end closure portion 15 and of an adjoining trapeziform transition portion 16. The latter merges into the cuboidal region of the coffee block 10. The closure seam 11 is located in the region of the rectangular closure portion 15, namely directly adjoining the free opening edge.

In the finished pack those portions of the fin fold 14 which project beyond the coffee block 10 are folded against the top and bottom end faces of the coffee block 10, so that a structure having a cuboidal overall shape is formed, which is placed inside an outer wrapping in the manner already described.

The airtightly closed pack, that is to say the composite sheet, must be opened for the purpose of use. In the region of the fin fold 14 a tear-open strip 17 is for this purpose provided, transversely to the sheet tube. This strip is disposed on the inner side of the composite sheet. The tear-open strip 17 is expediently already-disposed on the continuous undivided web of composite sheet, in a relative position corresponding to the position inside the pack. The tear-open strip 17 may be fastened to the composite sheet by heat sealing, but preferably by adhesive bonding.

In the examples of embodiment shown in FIGS. 1 to 4, the tear-open strip is situated in the region of the rectangular closure portion 15. The tear-open strip 17 extends over (nearly) the entire width of the pack.

On one side or at one end, namely in the region of a gripping end 18, of the tear-open strip 17 a grip tab 19 is formed out of the material of the composite sheet. This tab is situated in such a position relative to the tear-open strip 17, that is to say the gripping end 18 of the latter, that when the grip tab 19 is gripped and pulled the tear-open strip 17 is also gripped, and thus the composite sheet is slit open over the length of the tear-open strip 17.

The gripping end 18 and the grip tab 19 are situated in the region of a planar weld joint of sheet walls lying opposite one another, in the region of the closure portion 15 or of the transmission portion 16 (FIGS. 5 and 6). This side weld 20 serves on the one hand to maintain leaktightness and on the other hand to form a stiffening region assisting the initial phase of the operation of tearing open the pack.

In all the different embodiments the grip tab 19 is defined by punch cuts. The relative positions of the gripping end 18 and the grip tab 19, on the one hand, and the punch cuts on the other hand are important to achieve an adequate spacing ensuring leaktightness. This spacing should amount to 4 millimeters or more.

In one embodiment shown in FIG. 1, the grip tab 19 is bounded by two punch cuts 22, 23 made from a free side edge 21 of the pack. These punch cuts likewise end at the side edge 21 and extend inside the side weld 20 on both sides of the tear-open strip 17.

The latter ends at a considerable distance—viewed in the longitudinal direction of the punch cuts 22, 23 or of the tear-open strip 17—from the grip tab 19, and thus from the punch cuts 22, 23. The gripping end 18 of the tear-open strip 17 is however still situated in the region of the side weld 20, and is therefore gripped by the latter. A reliable opening operation is thereby possible despite the fact that the tear-open strip 17 does not extend entirely into the region of the grip tab 19. On the other hand, the distance between the gripping end 18 of the tear-open strip 17 and the punch cuts 22, 23 is so great that here the source of loss of leaktightness is reliably eliminated.

Figure 2:
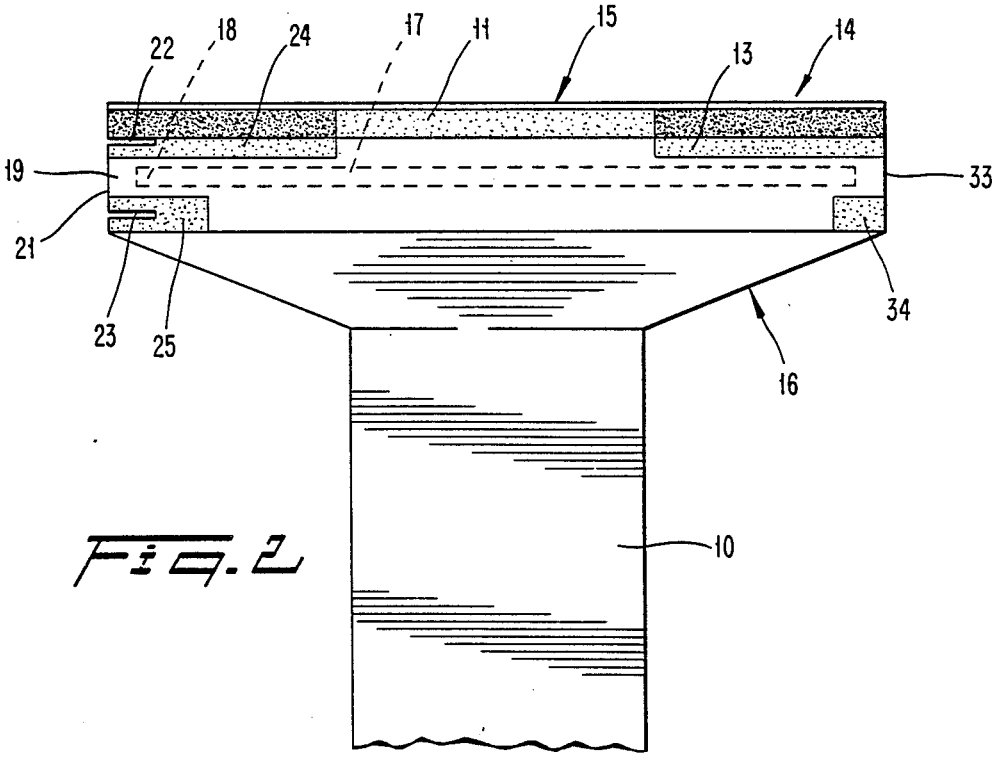
FIG. 2 is a view similar to FIG. 1, showing a different shape of the tear-open mechanism.

In the embodiment illustrated in FIG. 2 the grip tab 19 is likewise defined by punch cuts 22, 23 made from the side edge 21. The tear-open strip 17 is in this case taken almost to the side edge 21, but does not lie in the region of a side weld as in the case of FIG. 1, but lies free between two separate sealing welds 24, 25. These welds extend (approximately) parallel to the tear-open strip 17, above and below the latter, at a distance therefrom. The sealing action of these sealing welds 24, 25, resulting from the planar welding, is therefore not impaired by the tear-open strip 17. The latter can thus extend to the side edge 21.

The punch cuts 22, 23 delimiting the grip tab 19 are located in the region of the sealing welds 24, 25, but at a sufficient distance from the top and bottom edges to ensure leaktightness. The punch cuts 22, 23 are thus also located in an adequately sealed region.

Figure 3:
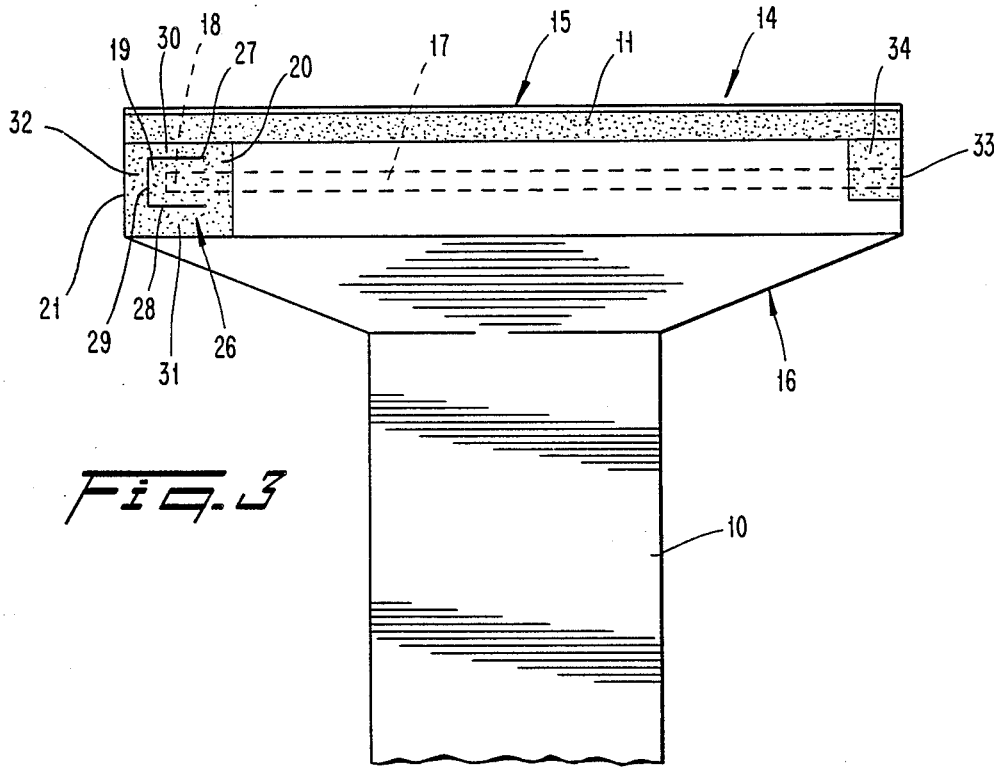
FIG. 3 is a view similar to FIGS. 1 and 2, showing a special form of grip tab for a tear-open strip.

FIG. 3 shows an embodiment distinguished by a particularly advantageous shape and arrangement of the grip tab 19. The latter is entirely disposed at a distance from the side edge 21, and therefore extends completely within the side weld 20.

This is made possible by special punching, which in the present example of embodiment is in the form of a U-shaped punch cut 26, that is to say a punch cut comprising two substantially horizontal portions 27, 28 extending one on each side of the tear-open strip 17 and a transverse punch cut 29 joining said two portions together. The punch cut delimiting the grip tab 29 may also be rounded, triangular or of similar shape. In all cases it produces a grip tab 19 in the form of a tongue which can be pressed laterally out of the plane of the welded composite sheet. For the purpose of holding in the other hand, a frame-like structure is left, which consists of a top web of material 30, a bottom web of material 31, and a transverse web 32 joining the other two webs together. The resulting frame-like portion can be gripped and held particularly easily when the grip tab 19 is pulled in the required manner. The tear-open mechanism formed in this way can also be applied to other types of packs made of sheet material.

On the basis of the above described formation of the grip tab 19 it is possible to provide a shortened tear-open strip. The grip tab 19 with the U-shaped punch cut is thereby shifted in the direction towards the center of the pack, that is the closure portion 15. As a result, when operating the tear-open mechanism only a partial region of the closure portion 15 is opened which forms a correspondingly smaller opening for extraction. With this embodiment, too, the U-shaped punch cut is surrounded by a sealing weld, corresponding to side weld 20.

In this case the gripping end 18 of the tear-open strip 17 ends at a distance from the U-shaped punch cut 26, so that leaktightness is ensured.

Figure 4:
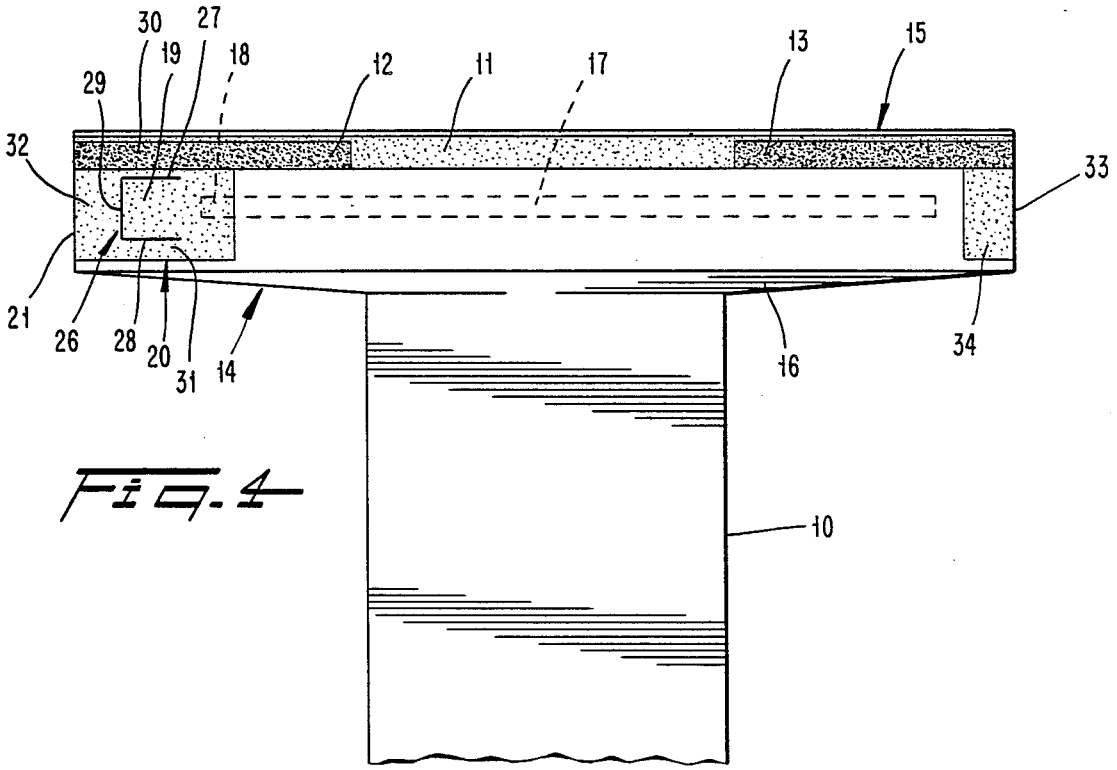
FIG. 4 is a side view of another embodiment of the present invention.

FIG. 4 shows an alternative to FIG. 3, which provides improved leaktightness. As can be seen, the previously described grip tab 19 is here disposed within a side weld 20 which is widened in the longitudinal direction of the tear-open strip 17. The tear-open strip 17, that is to say its gripping end 18, here ends at a distance—viewed in the longitudinal direction of the tear-open strip 17—from the U-shaped punch cut 26, and thus also from the free ends of the punch cut portions 27, 28. Optimum leaktightness is thereby achieved without the opening operation being impaired.

At the opposite end to that where the grip tab 19 is disposed, the tear-open strips 17 may extend as far as a free side edge 53. It is however more advantageous for the tear-open strips 17 to be delimited in such a manner that they end at a distance from the side edge 33, since increased loss of leaktightness may also occur in the region of this side edge. As an alternative, an end weld 34 is provided there and the corresponding end of the tear-open strip 17 can be anchored therein (FIG. 3).

FIGS. 5 and 6 show a vacuum pack in which the tear-open strip 17 is disposed in the region of the trapeziform transition portion 16. It is disposed therein similarly to the abovedescribed examples of embodiment, while a likewise trapeziform side weld 25 is provided to receive a grip tab 19 in the manner described. In order to ensure adequate stability and leaktightness, the side weld 20 in the region of the closure portion 15 is here retained. In respect of the dimensions and arrangement of the tear-open strip 17, the features described above are also applicable to this example of embodiment.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others without departing from the spirit of the present invention. Accordingly, it is expressly intended that all such variations and changes which fall within the spirit and scope of the present invention as defined in the claims, be embraced thereby.

We claim:

1. A vacuum pack comprising:

a body of multilayer composite sheet material having a pourable product located therein in the form of a block, said body surrounding the block and extending from both ends thereof, one end of said body extending from said block being provided with a closure seam which extends across said body so that the portion of said body which extends from said block forms a fin fold;

a tear-open strip on said body located between said block and said closure seam;

a side weld located along a portion of a side edge of said fin fold, said side weld securing together wall portions of said composite sheet material; and a punch cut located in said side weld, said punch cut defining a grip tab which can be grasped and pulled so as to initiate tearing of the pack, said tear-open strip extending across at least a portion of said fin fold and having one end located proximate to said punch cut and another end located distally from said punch cut, the end of said tear-open strip located proximate to said punch cut defining a gripping end of the tear-open strip, said gripping end being spaced from said punch cut so as to ensure that the side weld is tightly sealed and said gripping end of said tear-open strip being positioned in said side weld.

2. A vacuum pack in accordance with claim 1, wherein two punch cuts are located in the same side weld, the gripping end of said tear-open strip being spaced, in the direction of longitudinal extent of said tear-open strip, from said punch cuts.

3. A vacuum pack in accordance with claim 1, wherein said punch cut is spaced from said side edge of said fin fold so that portions of said side weld located above said punch cut, below said punch cut and between the side edge of the fin fold and the punch cut remain when said grip tab is grasped and pulled, whereby those portions of the side weld that remain can be held during grasping and pulling of the grip tab.

4. A vacuum pack in accordance with claim 3, wherein said punch cut is U-shaped.

5. A vacuum pack in accordance with claim 3, wherein said punch cut is U-shaped, the gripping end of said tear-open strip is positioned in said side weld and portions of said punch cut extend beyond the gripping end of said tear-open strip as measured in the direction of longitudinal extent of said tear-open strip.

6. A vacuum pack in accordance with claim 1, wherein said fin fold comprises a substantially rectangular shaped portion and a substantially trapezoidal shaped transition portion extending between the portion of said body surrounding the block and said substantially rectangular shaped portion, said side weld being located in the substantially trapezoidal shaped transition portion of the body and said side weld being substantially trapezoidal in shape.

7. A vacuum pack in accordance with claim 6, wherein two punch cuts are provided in said side weld for defining said grip tab.

8. A vacuum pack in accordance with claim 1, wherein an end weld is provided on a side edge of said fin fold which is opposite to the side edge where said side weld is located and wherein the end of said tear-open strip which is located distally from said punch cut is positioned in said end weld.

9. A vacuum pack in accordance with claim 1, wherein said punch cut extends inwardly from the side edge of said fin fold, said punch cut extending beyond the gripping end of said tear-open strip.

10. A vacuum pack in accordance with claim 1, wherein said punch cut is U-shaped, the gripping end of said tear-open strip is positioned in said side weld and the gripping end of said tear-open strip is spaced from said punch cut as measured in the direction of longitudinal extent of said tear-open strip.

11. A vacuum pack in accordance with claim 1, wherein said pourable product is ground roast coffee and said block is cuboidal in shape.

12. A vacuum pack in accordance with claim 1, wherein said tear-open strip is located on an interior portion of said composite sheet material.

13. A pack comprising:

a body of multilayer composite sheet material having a closure seam at one end of the body that extends across the body to form a fold;

a tear-open strip on said body located between said closure seam and an end of the body opposite to said one end;

a side weld located along a portion of a side edge of said fold, said side weld securing together wall portions of said composite sheet material; and a U-shaped punch cut located in said side weld, said punch cut defining a grip tab that can be grasped and pulled to initiate tearing of the pack, said tear-open strip extending across at least a portion of said fold and having one end located proximate to said punch cut and another end located distally from said punch cut, the end of said tear-open strip located proximate to said punch cut defining a gripping end of the tear-open strip, said gripping end being positioned in said side weld and being spaced from all portions of said punch cut in the direction of longitudinal extent of said tear-open strip to ensure that the side weld is tightly sealed, said punch cut being spaced from the side edge of the fold so that portions of said side weld located above said punch cut, below said punch cut and between the side edge of the fold and the punch cut remain when said grip tab is grasped and pulled, whereby those portions of the side weld that remain can be held during grasping and pulling of the grip tab.

14. A pack in accordance with claim 13, wherein said fold is a fin fold.

15. A vacuum pack comprising:

a body of multilayer composite sheet material having a pourable product located therein in the form of a block, said body surrounding the block and extending from both ends thereof, one end of said body extending from said block being provided with a closure seam which extends across said body so that the portion of said body which extends from said block forms a fin fold;

a tear open strip on said body located between said block and said closure seam;

a side weld located along a portion of a side edge of said fin fold, said side weld securing together wall portions of said composite sheet material; and a U-shaped punch cut located in said side weld, said punch cut defining a grip tab which can be grasped and pulled so as to initiate tearing of the pack, said tear-open strip extending across at least a portion of said fin fold and having one end located proximate to said punch cut and another end located distally from said punch cut, the end of said tear-open strip located proximate to said punch cut defining a gripping end of the tear-open strip, said gripping end being positioned in said weld and being spaced from said punch cut as measured in the direction of longitudinal extent of said tear-open strip so as to ensure that the side weld is tightly sealed.

* * * * *